United States Patent [19]

Okazaki

[11] Patent Number: 4,727,348

[45] Date of Patent: Feb. 23, 1988

[54] THERMAL FUSE

[75] Inventor: Tasuku Okazaki, Nara, Japan

[73] Assignee: Tachibana Metal Co., Ltd., Osaka, Japan

[21] Appl. No.: 942,628

[22] Filed: Dec. 16, 1986

[51] Int. Cl.[4] ..... H01H 37/76

[52] U.S. Cl. ..... 337/403; 337/407

[58] Field of Search ..... 337/403, 404, 407, 408, 337/409

[56] References Cited

U.S. PATENT DOCUMENTS

| | | | |
|---|---|---|---|
| 3,956,725 | 5/1976 | Merrill et al. | 337/407 |
| 4,179,679 | 12/1979 | Houghland | 337/408 |
| 4,255,736 | 3/1981 | Kelley et al. | 337/407 |
| 4,297,669 | 10/1981 | Gale | 337/407 |

*Primary Examiner*—Harold Broome

*Attorney, Agent, or Firm*—Wenderoth, Lind & Ponack

[57] ABSTRACT

A thermal fuse has an insulative tubular case, two lead wires, a lead wire separating tool, an electrode plate consisting of two conductive metal plates deposited with fusible alloy which fuses at a preset temperature and an elastic body which presses the electrode plate. When the fusible alloy fuses at a preset temperature, the elastic body is released from compression and its top end portion is inserted in a cavity of the lead wire separating tool so that one end of each of the conductive metal plates is released from contact with the lead wire and the electric circuit between the lead wires is opened.

4 Claims, 6 Drawing Figures

THERMAL FUSE

BACKGROUND OF THE INVENTION

1. Field of the Invention

This invention relates to a thermal fuse which can be assembled automatically and works accurately.

2. Description of the Prior Art

Conventionally, a thermal fuse is connected to a circuit as a safety means for various electric appliances and electric circuits. This conventional thermal fuse is so designed that when a preset temperature is reached, fusible alloy which constitutes a part of the electric circuit fuses and opens the electric circuit, thereby protecting electric appliances and preventing a fire. In this thermal fuse, two lead wires arranged oppositely or in parallel with each other are brought compulsorily into contact with each other to close the electric circuit between the two lead wires and a contact part is deposited with fusible alloy which is adapted to fuse at the preset temperature. Therefore, when the temperature of the electric circuit itself reaches the preset temperature due to the flow or impression of more electric current or voltage than present in the electric circuit, with resultant overload on the electric circuit, or when the ambient temperature is higher than the preset temperature, the fusible alloy connecting the two lead wires and closing the electric circuit fuses and opens the electric circuit.

In the above conventional thermal fuse, an electrode wire bridges two lead wires and an intersecting point of each lead wire, and the electrode wire is deposited with fusible alloy so as to close an electric circuit between the two lead wires. Therefore, two deposition portions are provided and it is necessary to provide a means for preventing the electrode wire from contacting again after the fusible alloy fused and the electrode wire was separated from the lead wires, namely, the electric circuit was opened.

In assembling the conventional thermal fuse, lead wires are deposited directly with fusible alloy and therefore full automation of the assembling process is difficult to realize and it requires much trouble to assemble the thermal fuse, especially in the case of a thermal fuse of super small-size.

In the case where depositing of the electrode rod is effected while two lead wires are compressed by springs, such compression must be maintained until the fusible alloy hardens.

SUMMARY OF THE INVENTION

Two lead wires $L_1$, $L_2$ are inserted in a case 1 of the thermal fuse which is formed of insulative material and is tubular in shape, and which has a bottom. A lead wire separating tool 2 which is made of insulative material and has a C-shape is pushed deep into the inner bottom part of the case. This separating tool 2 is intended to keep the forward ends of the two lead wires $L_1$, $L_2$ separated from each other and to fix an electrode plate 3 thereto. The electrode plate 3 comprised of two conductive plates deposited with fusible alloy which fuses at the preset temperature is pressed by top ends of the separating tool 2 and by an elastic body 5 which is fixed and supported in the case by spring pressure so that both ends of the electrode plate are pressed against the lead wires $L_1$, $L_2$ to close the circuit between the two lead wires.

Figure 1:
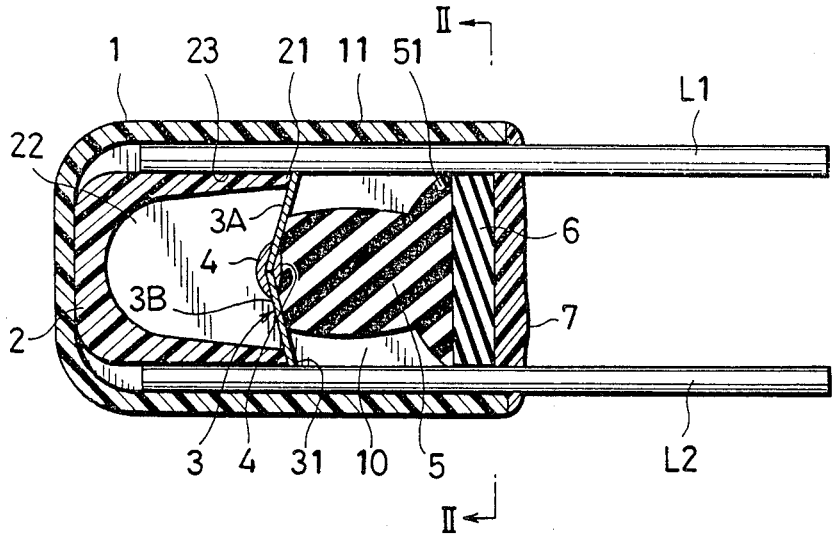
FIG. 1 is a longitudinal sectional view of the thermal fuse according to the present invention.
Figure 2:
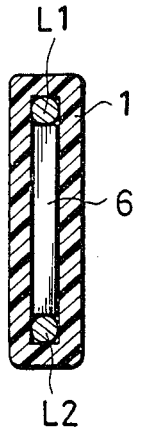
FIG. 2 is a cross-sectional view of the thermal fuse, taken along line II—II in FIG. 1.

FIGS. (1), (2), (3) are an explanatory drawing of the elastic body.

DETAILED DESCRIPTION OF THE INVENTION

The thermal fuse according to the present invention is described below with reference to a preferred embodiment and drawings.

Reference numeral 1 designates a tubular case with an opening at one end and a bottom at the other end. The case is made of insulative material, such as ceramics, heat-resistant synthetic resin, etc. The case 1 should be of such size that it can easily be incorporated in the circuit of an electric appliance.

Reference symbols $L_1$, $L_2$ designate lead wires or conductive wire rods. One end of each lead wire projects from the case for connection to an electric circuit (not shown in the drawing) and the other end extends in the case. These two lead wires are inserted in the case in such a fashion that they contact two opposite inner surfaces of the case and a lead wire separating tool 2 is pushed in the case along these two lead wires so as to keep the two lead wires separated.

The lead wire separating tool 2 is also made of insulative material, such as ceramics, heat-resistant synthetic resin, etc. and has a C-shape. Two ends 21, 21 of the lead wire separating tool 2 support one side surface of an electrode plate 3 (to be described later). A cavity 22 is provided between these two ends 21, 21 and in this cavity an end portion of an elastic body 5 is inserted. When the lead wire separating tool 2 is pushed into the case, two outer side surfaces 23, 23 press the lead wires $L_1$, $L_2$ against the inner side surfaces 11 of the case 1, whereby the lead wires $L_1$, $L_2$ inside the case are engaged with the case while being separated from each other.

The electrode plate 3 is made of conductive metal, such as copper, brass, phosphor bronze, etc., and comprises two plates 3A, 3B deposited with fusible alloy 4 which fuses at a preset temperature. These two plates 3A, 3B should be a little larger in total length than the distance between the two lead wires supported in the case. For example the two plates 3A, 3B should preferably be arranged to have a flattened V-shape. When the electrode plate 3 is pushed in the case between the lead wires $L_1$, $L_2$, free ends 31, 31 of the electrode plate 3 press against the lead wires $L_1$, $L_2$ and thus the electric circuit between the lead wires $L_1$, $L_2$ is closed. In this state, the electrode plate 3 is in a very unstable condition and therefore an elastic body 5 is used to support the electrode plate safely between the two lead wires and open the circuit between the two lead wires accurately.

The elastic body 5 is made of rubber or soft synthetic resin having a characteristic in that its elasticity is not impaired within the range of temperatures at which the thermal fuse works. This elastic body 5, irrespective of whether it is rubber or synthetic resin, is shaped so that its stretching direction, when it is released from the compressed state, is predetermined. For example, a basic end side 51 has a larger area than the top end portion so that the elastic body 5 can be seated stably on the fixing side.

The elastic body 5 is pushed in the case until its top end side strikes against one side surface of the electrode plate 3 and then a lid 6 is pushed into a case inner room 10 between the two lead wires $L_1$, $L_2$. The lid 6 has a plate-shaped and is made of insulative material, such as ceramics, synthetic resin, etc. The lid 6 is pushed into the case in such a fashion that it presses the lead wires $L_1$, $L_2$ against the inner side surfaces 11, 11 of the case so that the lid 6 is fixed firmly by friction with the lead wires $L_1$, $L_2$. When the lid 6 is pushed into the case, the elastic body 5 assumes a compressed state.

With the compression of the elastic body 5, the electrode plate 3 is pressed firmly by top ends of the lead wire separating tool 2 and consequently top ends 31, 31 of the electrode plate 3 are pressed firmly against the lead wires.

Assembling of the thermal fuse is completed with the pushing in of the lid 6. However, for the purposes of stabilizing the pushing-in of the lid, preventing the entry of dust and other alien substances into the case, damproofing, etc., the outer side surface of the lid 6 and the end surface of the opening of the case are sealed hermetically with a sealing material 7, such as silicon synthetic resin, epoxi synthetic resin, etc.

Figure 3:
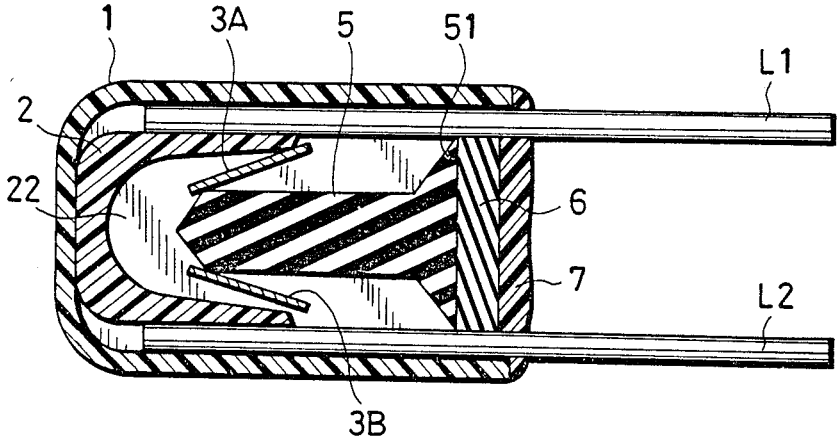
FIG. 3 is a cross-sectional view of the thermal fuse when in operation.
Figure 3:
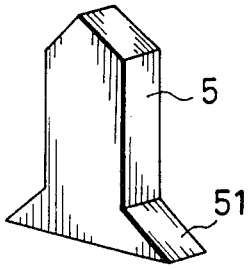
Figure 3:
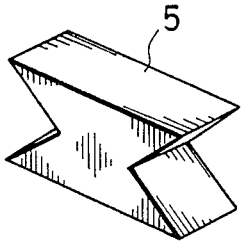
Figure 3:
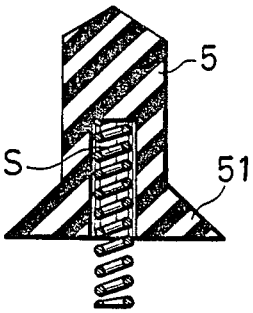

When the thermal fuse according to the present invention is used by connecting it to an electric circuit, if the fusible alloy fusing temperature is reached due to excessive electric current or a rise in the ambient temperature, the fusible alloy fuses and the electrode plate which has been sandwiched between the lead wire separating tool and the compressed elastic body divides into two at the intermediate deposition portion, whereupon the elastic body 5 is released from the compressed state and assumes a restored state. Thus, the elastic body elongates and its top end portion enters into a cavity of the lead wire separating tool. Two electrode plate materials 3A, 3B which have been separated from each other are forced between the inner side surface of the lead wire separating tool and the elastic body, as shown in FIG. 3. Thus, the electric circuit between the two lead wires $L_1$, $L_2$ is opened.

In the embodiment described above, the elastic body 5 as shown in FIG. 4 (1) is used but it can be substituted by any equivalent such as that shown in FIG. 4 (2) which is a plate material having elasticity such as that possessed by synthetic resin, with opposing V-shaped notches at both side surfaces thereof. In this case, the body 5 is used with pressure applied from its upper side and bottom side. Another equivalent as shown in FIG. 4 (3) is the same in shape as the elastic body shown in FIG. 4 (1) but is made of ceramics or synthetic resin that is hard or semi-hard and has a spring S in its cavity. The desired resiliency can be obtained by putting the spring S in a compressed state.

The thermal fuse according to the present invention can take any shape other than shown in the drawings, so long as it has the same object and the same action as the present invention and is within the scope of the appended claims.

According to the present invention, assembling of a thermal fuse is very simple because parts are pushed into the case one by one from the opening of the case and automatic assembling is possible. Thus, the present invention facilitates improved productivity and assembling of small-size thermal fuses. Since two electrode plates are deposited with fusible alloy at only one portion, the deposition part is minimized. Moreover, since the top ends of the electrode plate pressed against the lead wires are biosed by a compressed elastic body, the electric circuit is opened accurately upon fusing of the fusible alloy.

What is claimed is:

1. A thermal fuse comprising:

an insulative tubular case having a bottom;

two spaced apart lead wires extending within said case;

a lead wire separating tool for maintaining said two lead wires spaced apart within said case;

an electrode plate extending between said lead wires and having respective ends each of which contacts a respective one of said lead wires for defining a closed circuit between said wires, said electrode plate comprising two plates held together by a fusible alloy that fuses at a predetermined temperature;

a lid; and a compressed elastic body within said case contacting said electrode plate and said lid for expanding to separate said plates and open the circuit between said lead wires when said alloy fuses at the predetermined temperature, the electrode plate disposed within said case between said lead wire separating tool and said elastic body.

2. A thermal fuse as claimed in claim 1, wherein said lead wire separating tool is comprised of insulative material and has a cavity extending therein over which said electrode plate spans, and said elastic body contacts said electrode plate opposite said cavity so as to separate said plates of the electrode plate and press them against respective inner surfaces of said separating tool defining said cavity when said alloy fuses at the predetermined temperature.

3. A thermal fuse as claimed in claim 1, wherein said electrode plate has a flattened V-shape and said plates are two conductive metal plates.

4. A thermal fuse claimed in claim 1, wherein said elastic body has uniform elasticity throughout and has a base end and a top end, the base end having a larger cross-sectional area than said top end so that when said elastic body compressed within the case expands, said elastic body expands in a predetermined direction extending from said base end to said top end.

* * * * *